US009027277B2

(12) United States Patent
Castleberry

(10) Patent No.: US 9,027,277 B2
(45) Date of Patent: May 12, 2015

(54) CUT FLOWER SHIPPING CONTAINER

(71) Applicant: Chrysal International BV, Naarden (NL)

(72) Inventor: Wayne Castleberry, Richmond, VA (US)

(73) Assignee: Chrysal International BV, Naarden (NL)

( * ) Notice: Subject to any disclaimer, the term of this patent is extended or adjusted under 35 U.S.C. 154(b) by 95 days.

(21) Appl. No.: 13/573,825

(22) Filed: Oct. 9, 2012

(65) Prior Publication Data

US 2014/0096444 A1 Apr. 10, 2014

(51) Int. Cl.

| | |
|---|---|
| ***A01G 5/00*** | (2006.01) |
| ***A47G 7/00*** | (2006.01) |
| ***A47G 7/06*** | (2006.01) |
| ***A47G 5/00*** | (2006.01) |
| ***B65D 85/50*** | (2006.01) |

(52) U.S. Cl.

CPC .. *A47G 7/06* (2013.01); *A47G 5/00* (2013.01); *B65D 85/505* (2013.01)

(58) Field of Classification Search

CPC ..... B65D 85/505; B65D 25/023; A47G 7/06; A47G 7/07; A47G 7/02; A01G 5/00

USPC ..... 47/41.15, 41.11, 41.01

See application file for complete search history.

(56) References Cited

U.S. PATENT DOCUMENTS

| | | | | |
|---|---|---|---|---|
| 522,910 | A * | 7/1894 | Marston | 24/6 |
| 1,402,904 | A * | 1/1922 | Skidmore | 47/41.11 |
| 1,624,407 | A * | 4/1927 | Hamilton | 47/41.11 |
| 4,165,835 | A * | 8/1979 | Dearling | 239/51.5 |
| 5,060,799 | A | 10/1991 | De Pagter | |
| 5,491,929 | A * | 2/1996 | Peacock et al. | 47/84 |
| 6,446,827 | B1 | 9/2002 | Akins | |
| 6,581,330 | B1 | 6/2003 | Helsloot et al. | |
| 6,752,270 | B1 | 6/2004 | Helsloot et al. | |
| 6,907,692 | B2 * | 6/2005 | Hintze | 47/41.12 |
| 7,260,914 | B2 * | 8/2007 | O'Connor | 47/41.01 |
| 8,096,416 | B2 | 1/2012 | De Pagter et al. | |
| 2005/0150888 | A1 * | 7/2005 | Birkmeier | 220/229 |
| 2006/0096170 | A1 * | 5/2006 | Wright | 47/41.01 |

FOREIGN PATENT DOCUMENTS

| | | | | |
|---|---|---|---|---|
| EP | 410190 | A1 * | 1/1991 | A47G 7/06 |
| EP | 1842421 | A1 * | 10/2007 | A47G 7/07 |
| GB | 2298136 | A * | 8/1996 | A47G 7/07 |
| GB | 2461579 | | 1/2010 | |
| JP | 01131625 | A * | 5/1989 | A47G 7/06 |
| JP | 06253964 | A * | 9/1994 | A47G 7/02 |
| JP | 2008061757 | A * | 3/2008 | |
| NL | 9400634 | | 4/1994 | |
| WO | WO 2006/107204 | | 10/2006 | |
| WO | WO 2007/011224 | | 1/2007 | |

* cited by examiner

*Primary Examiner* — Son T Nguyen

(74) *Attorney, Agent, or Firm* — Leydig, Voit & Mayer, Ltd.

(57) ABSTRACT

The invention is directed toward a spill- and leak-proof container for floriculture items including cut flowers, stems, other horticultural items, and the like. More specifically, the invention includes a receptacle having funnel-like primary closure. The funnel-like primary closure includes a wider opening generally adjacent to and contiguous with the mouth of the receptacle. The narrower opening of the funnel-like primary closure is positioned in the interior of the receptacle. A secondary closure atop the wider opening of the primary closure ensures no liquid can spill.

8 Claims, 11 Drawing Sheets

CUT FLOWER SHIPPING CONTAINER

RELATED APPLICATIONS

There is no related application.

STATEMENT REGARDING FEDERALLY SPONSORED RESEARCH OR DEVELOPMENT

Not applicable.

REFERENCE TO SEQUENCE LISTING, A TABLE OR A COMPUTER PROGRAM LISTING COMPACT DISC APPENDIX

None.

BACKGROUND OF THE INVENTION

1. Field of Invention

The present invention relates to spill-proof containers. More particularly, the present invention is directed toward a container for cut flowers, stems, horticultural items, and the like providing a fluid reservoir for maintaining the hydration fluid for the items contained therein. The container facilitates handling, storage, transport, and display of cut flowers while greatly reducing the likelihood of damage and prolonging the useful life of the cut flowers.

2. Background of the Invention

Once a flower is cut, it is deprived of water, food and growth hormones naturally provided by its mother plant. In order for a fresh cut flower to reach its full bloom while retaining its color and scent, it must have access to water at every phase of the distribution chain. When a cut flower is unable to access water, its vascular bundles begin to close and it is unable to absorb the necessary amount of water unless the flower's stem is re-cut and hydrated. As of 2011, floriculture in the United States, including flowers, cut stems, plants, and related horticultural items and goods is estimated to be a $32.1 billion industry. About 20% of fresh cut flowers transactions occur at a florist and 45% of the total dollars spent on fresh-cut flowers occur at a florist. About 52% of fresh cut flower transactions occur at a supermarket and 28% of the total dollars spent on fresh cut flowers occur at a supermarket. Bouquet purchases account for approximately 64% of cut flower sales at a supermarket. Cut flowers make up approximately 70% of total online floral purchases in the US. By their nature, these cut flowers tend to be quite delicate and unable to withstand rough handling or periods of dehydration. Hence, time from cutting to sale is of the essence throughout the industry. With the advent of expedited shipping and transportation services, producers are now able to transport their products great distances in a matter of days. Nevertheless, losses due to wilting and spoilage of the cut flowers are a reality of the industry and account for a significant portion of unrealized sales. In internet retail sales, internet retailers ship flowers "dry", or without water. An online order can take anywhere from 1-4 days to ship. As a result online flowers often arrive at the final destination wilted. With time and hydration, the flowers return to their pre-shipping condition, however, initial flower receipt quality drives customer perception and effects future customer behavior. Flowers that arrive wilted are typically perceived as lower quality flowers by the consumer.

In supermarket sales, cut flowers are exposed to flower specific secretions, decomposing leaves and microorganisms, dust and other pollutants from the air. These contaminates clog the flower's vascular bundles, and prevent the flower from getting access to sufficient amount of available water. While on display at supermarkets, customers typically remove bouquets from their buckets containing water supply, inspect them and place them back into the buckets above the water supply. Depending on the time of year, conditions of the surrounding environment and type of cut flowers, water can be depleted through evaporation or through flower consumption leading the aforementioned problems. Without access to water, flowers within the bouquet will begin to wilt. Wilted flowers are neglected by customers, and after a certain amount of time, must be thrown away. Cut flower waste or "shrink" at the supermarket level typically range between 8% and 12% of the total flowers offered for sale. Waste represents the number of flowers that aren't sold during the retail display period (typically 5 days). Customers are looking for two things when purchasing cut flowers: first a fresh appearance and secondly a preferred bouquet arrangement. A secondary problem occurs during transport and while on display at supermarkets, as water evaporates from the open buckets and must be refilled. When store employees add water to buckets, water can spill on the floor and create a slipping hazard which exposes the retailer to slip and fall related liability.

The present invention is a container for cut flowers designed to prevent spillage of the hydrating fluid while allowing the flowers to be continuously hydrated. The present container is designed to hold enough water for 5-8 days of transport for the European Market. (250 ml or 8.5 oz. of total water) or 7-11 days of transport for the US Market. (350 ml or 11.8 oz. of total water) The containers are leak resistant if shipped horizontally, puncture resistant and stackable.

The early containers for shipping cut flowers range from a simple box as shown by U.S. Pat. No. 5,060,799 issued Oct. 29, 1991 to a more complex crate as shown by U.S. Pat. No. 6,581,330 issued Jun. 24, 2003. Long stemmed flowers have been packed in a more complex packaging as shown by U.S. Pat. No. 6,752,270 issued Jun. 22, 2004 and U.S. Pat. No. 8,096,416 issued Jan. 17, 2012. Shipping containers for cut flowers providing hydration medium in the containers in the nature of mineral wool, polypropylene or polyester/polyethylene are disclosed in WO 2006/107204 published Oct. 12, 2006 and WO 2007/011224 published Jan. 25, 20007. It is also known in the prior art to use spill proof containers. U.S. Pat. No. 6,446,827, issued Sep. 10, 2002 discloses a paint container having a rectangular shaped paint holding bucket, an intermediate member with a centrally positioned funnel mounted to the top end rim of the bucket and a cover mounted over the intermediate funnel member. Similarly, United Kingdom Patent Number GB 2461579 published Jan. 6, 2010 is directed to a container with an anti-spill access lid formed with an inwardly directed tapered sleeve which extends into the container. Netherlands Patent Number 9400634 having a filing date of Apr. 20, 1994 discloses a cut flower holder with a stacked inverted flower pot container having an open upper end which is closed by a cap assembly which snaps over the upper lip of the upper flower pot section. The cap assembly has a disc shaped upper portion with a funnel member extending downward from the base of the disc into the chamber of the stacked flower pot container. The bottom of the funnel member is closed but has a plurality of throughgoing apertures which allow water into the funnel. The top of the funnel member is wider than the base and is open to receive the stems of a bunch of cut flowers.

What is needed, therefore, are methods and/or apparatuses for prolonging the useful life of floriculture items. Ideally, the devices will allow the items to withstand the rough handling of commercial production operations, and transportation delays, and in addition may be used in a retail setting to display cut flowers and the like.

SUMMARY OF THE INVENTION

The present invention is generally directed toward a spill-proof container for cut flowers, stems, horticultural items, and the like used during commercial transportation and retail display of the same. More specifically, the invention includes a container for cut flowers where their blooms, leaves, stems, and the like extend from a primary closure comprising a funnel-shaped structure having an opening capped by a disc member defining a plurality of radial cuts forming flexible, segments. This allows access of the stems into the interior chamber of the container which prevents hydrating liquid from reaching the opening and spilling out regardless of the container's orientation. The funnel-like shape of the primary closure also facilitates filling of the container and/or insertion of flower stems therein. The radial slitted disc member and flexible segments hold the stems and the funnel shaped structure prevents leakage of hydrating fluid when the container is on its side or upended, and facilitates display, growth, viability and shipping. Additionally, the container assembly facilitates loading of the container inasmuch as the funnel-shaped opening eases insertion of stems and the like into the container chamber. A secondary closure member mounted generally adjacent the primary closure member seated on the funnel opening eliminates spillage of any liquids bypassing the primary closure member and additionally functions to space and secure the stems within the container. In a preferred embodiment the container includes flattened portions on its sidewall(s) and a flattened bottom to facilitate loading, transport and storage of, and displaying the cut flowers, stems, and other horticultural products contained therein, and to provide anti-roll properties. In another embodiment, the container is tubular.

It is an object of the invention to provide a spill- and leak-proof container for floricultural products, including cut flowers and related horticultural items.

It is yet another object of the invention to provide a spill preventative container for floricultural products that extends the viability of items contained therein.

It is a further object of the invention to provide a spill preventative container for floricultural products that facilitates easy loading of the products therein.

These and other objects, advantages, and novel features of the present invention will become apparent when considered with the teachings contained in the detailed disclosure along with the accompanying drawings.

DESCRIPTION OF THE INVENTION

Figure 1:
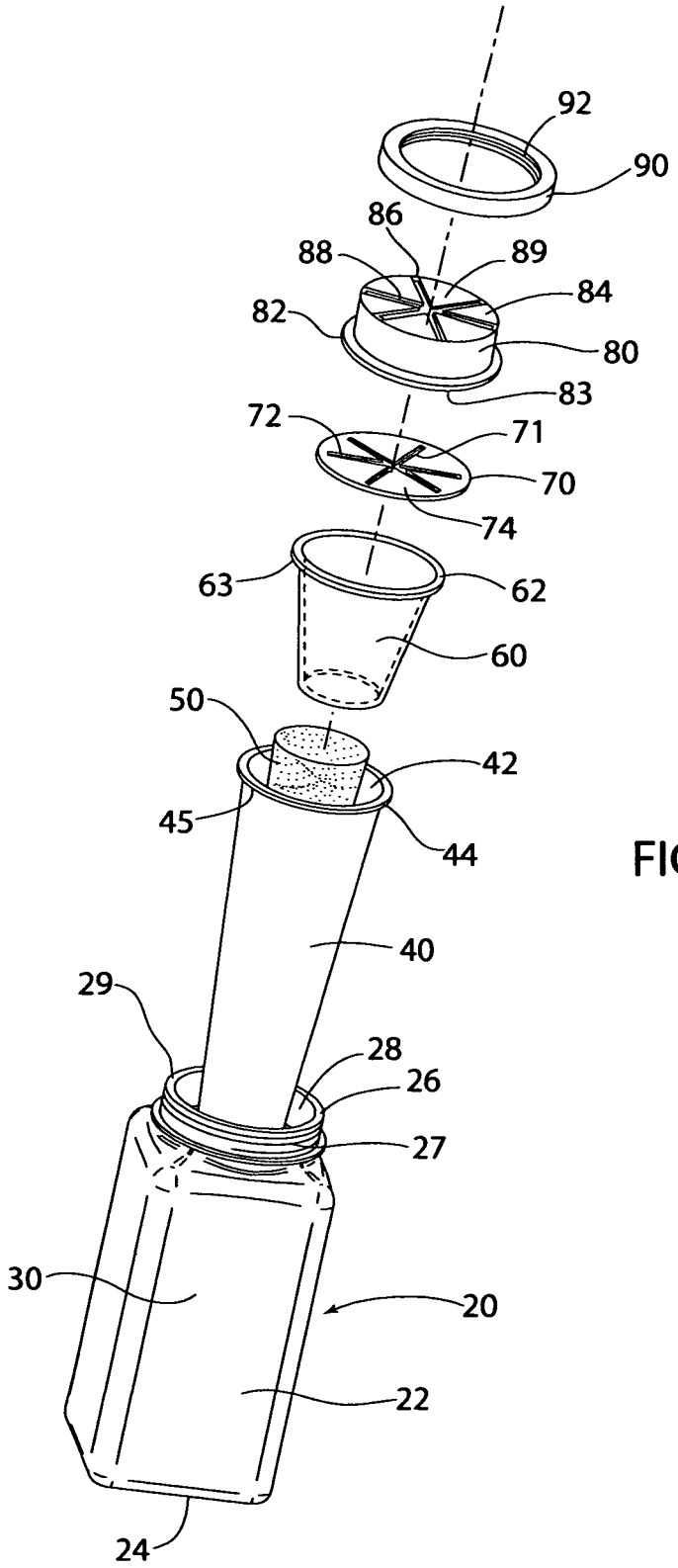
FIG. 1 is an exploded perspective view of the cut flower container invention.
Figure 2:
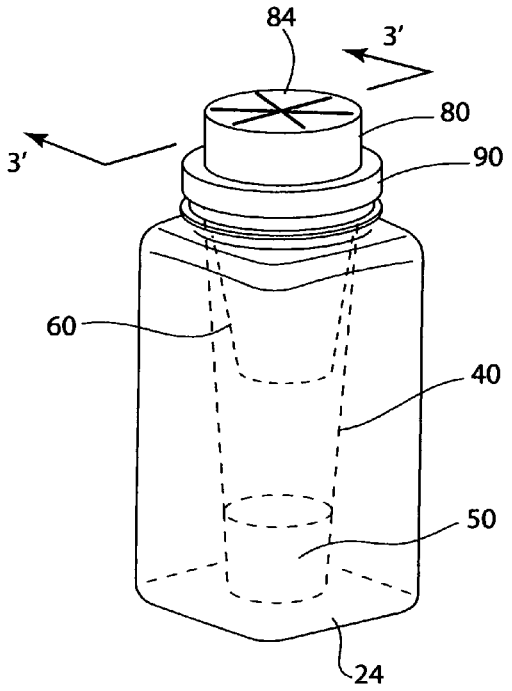
FIG. 2 is a perspective view of the invention shown in FIG. 1 with the stem funnel sleeve shown in phantom.
Figure 3:
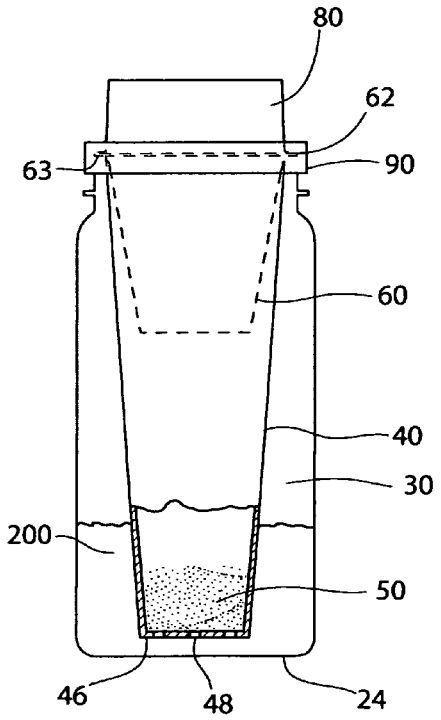
FIG. 3 is a cross section side elevation view taken across line 3'-3' of FIG. 2.
Figure 4:
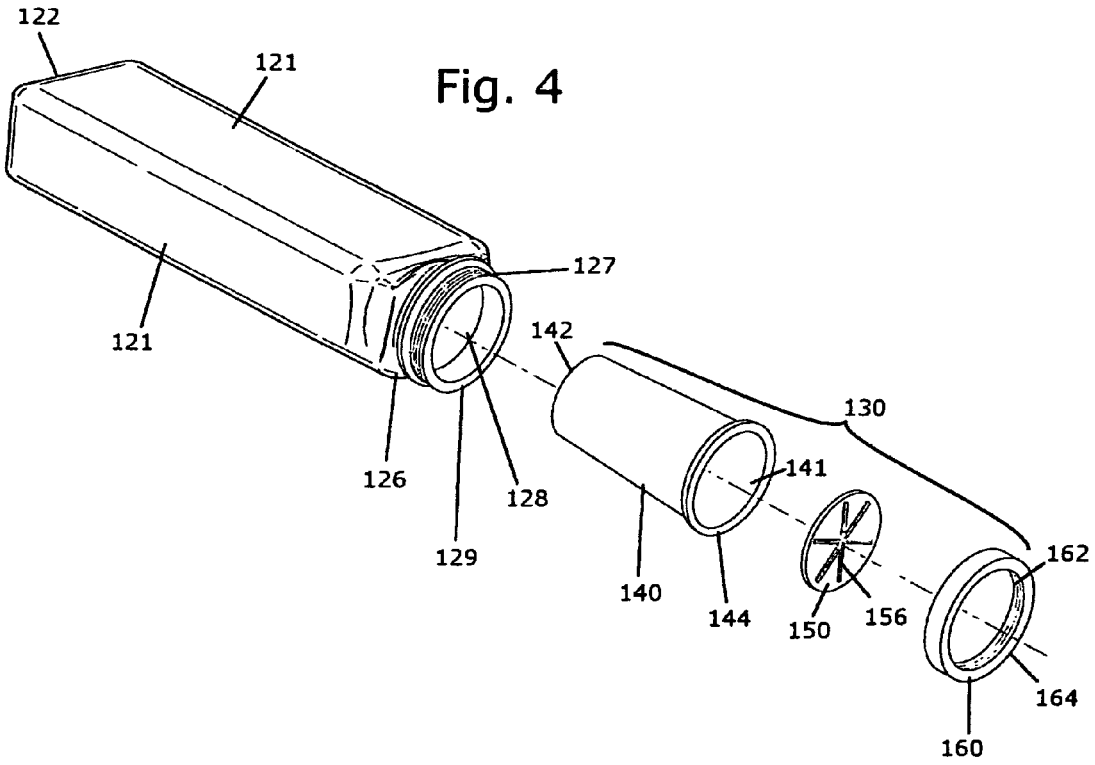
FIG. 4 is an exploded perspective view of another embodiment of the cut flower container invention.
Figure 5:
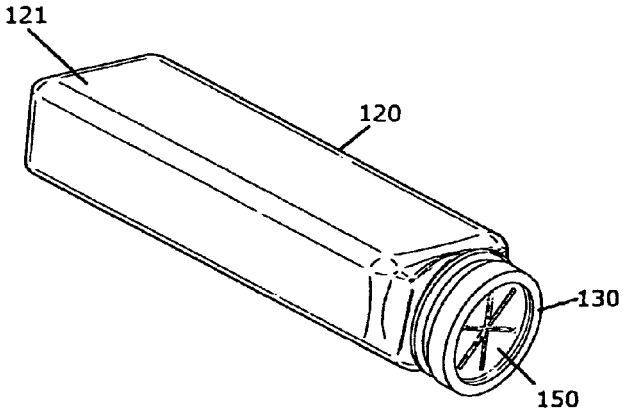
FIG. 5 is a perspective view of the assembled cut flower container shown in FIG. 4.

The preferred embodiment and best mode of the invention is shown in FIGS. 1 through 3. This mode is set forth for the limited purpose now required by statute. While the invention is described in connection with certain embodiments, it is not intended that the present invention be so limited and it is intended to cover all alternatives, modifications, and equivalent arrangements as may be included within the spirit and scope of the invention as defined by the appended claims.

This invention may be constructed from any suitable material including but not limited to various polymers and/or plastics, for example, polyethylene, polypropylene, various aramids, polyamides, ethylene vinyl acetate (EVA), fluoroplastics (PTFE, FEP), expanded polypropylene (EPP), nylons, polyamides (PA), polybutene, polycarbonate, polyacetals, polyesters, polystyrene, polyvinyl chloride, phenolics, polyurethane, vinyl esters, polyisocyanate polymer diphenylmethane diisocyanate (MDI), including any foamed and/or expanded conformations of same, other polymers, various metals and their alloys, biodegradable materials, environmentally sustainable materials, combinations thereof, and the like. Similarly, the invention may be fabricated using any suitable process or combination of processes including but not limited to molding, blow-molding, roto-molding, pressure forming, machining, computer numerical control (CNC) milling, and the like.

The preferred embodiment of the invention is shown in FIGS. 1-3. In the Figures, a container body 20 having planar side walls 22 and a planar bottom wall 24 is provided with a tubular neck 26 extending away from the planar side walls 22 having external threads 27 and defining an opening 28. The circular opening 28 has a planar end surface 29 and provides access into a chamber 30 formed by the side walls 22 and bottom wall 24. A tapered funnel member 40 having an open proximal end 42 with an outwardly extending circumferential lip 44 is sized to fit into the chamber 30 of container body 20 with the lip bottom surface 45 resting and being seated upon on the upper end surface 29 of the neck 26. A tapered frustum conical foam member 50 is inserted into the funnel member 40 until it rests against the distal end against the funnel member bottom end piece 46. The end piece 46 is provided with throughgoing wicking holes 48 as shown in FIG. 3 allowing hydrating fluid 200 placed in the chamber 30 to wick into the foam member to hydrate the ends of flower stems which are pressed against the upper surface of the foam member 50. A secondary funnel shaped spacer member 60 with an upper or proximal circumferential extending lip 62 is inserted into the funnel member 40 with the lower surface 63 of lip 62 being seated on the circumferential lip 44 of the tapered funnel member 40. A circular flat disc 70, as more clearly seen in FIG. 12, defining radial slits 72 extending outward from a central aperture or point 71 form flexible flap sections 74 is seated on the upper surface of lip 62 of the secondary funnel shaped spacer member 60 to hold the stems of the cut flowers in a fixed position. A cylindrical top member 80, as more clearly seen in FIG. 13, having a lower extending circumferential lip 82 provided with a bottom planar surface 83 is seated on the upper surface of the flat disc 70. Opposite lip 82 is a flat disc shaped end member 84 defining radial slits 86 extending outward from a central point 88 is secured on the distal end of cylindrical top member 80. The radial slits 86 form flexible flap sections 89 to hold the stems of the cut flowers a spaced distance from disc 70. The entire cap assembly is held in place by a circular locking ring 90 with internal threads 92 is mounted over the funnel member lip 44, secondary funnel spacer member lip 62, disc 70, and cylindrical top member lip 82 and is secured to the neck threads 27 of the container body to hold the complete assembly in a fixed position so that a bouquet of cut flowers can be held and hydrated by the fluid 200 in the container.

In FIGS. 4 through 7, an alternate embodiment of the container is shown including a container 120 of generally conventional form and closure assembly 130 mounted thereto. In this embodiment, the container 120 is generally formed in the shape of a rectangle or cube. The container 120 has planar sides 121 which are generally coplanar. The container 120 includes a planar bottom 122 facilitating freestanding use of the container and a cylindrical neck 126 which open. The neck 126 interconnects the sides 121 forming a generally circular mouth 128. The neck 126 has external threads 127 that are complimentary to internal threads 162 of the locking ring 160 (discussed in detail below).

The closure assembly 130 is mounted to the cylindrical neck 126. The closure assembly includes a funnel shaped insert 140 having an inwardly sloping contiguous sidewall forming a tapered funnel-like, frustum conical structure having openings 141 and 142 at both ends. The opening 141 is defined by lip 144 which is adjacent and flush with the planar end surface 129 of the neck 126. When assembled, the funnel insert 140 projects into the interior chamber of the receptacle 120. It will be understood by one skilled in the art that anti-spill inserts having other shapes may operate in the same or similar manner.

Figure 6:
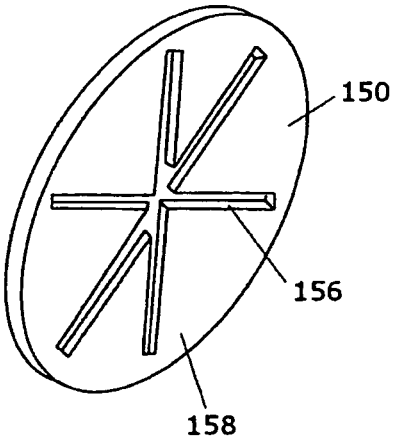
FIG. 6 is an enlarged perspective view of the disc stem holder shown in FIG. 4.
Figure 7:
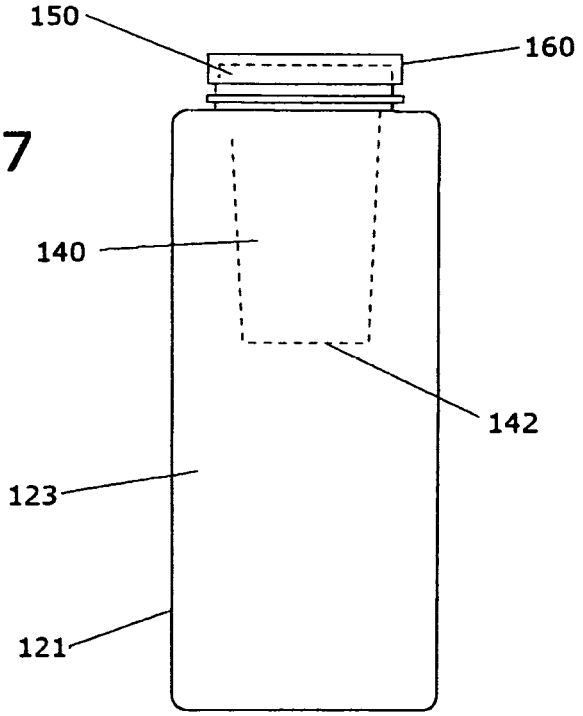
FIG. 7 is a side elevation of the cut flower container shown in FIG. 5.
Figure 8:
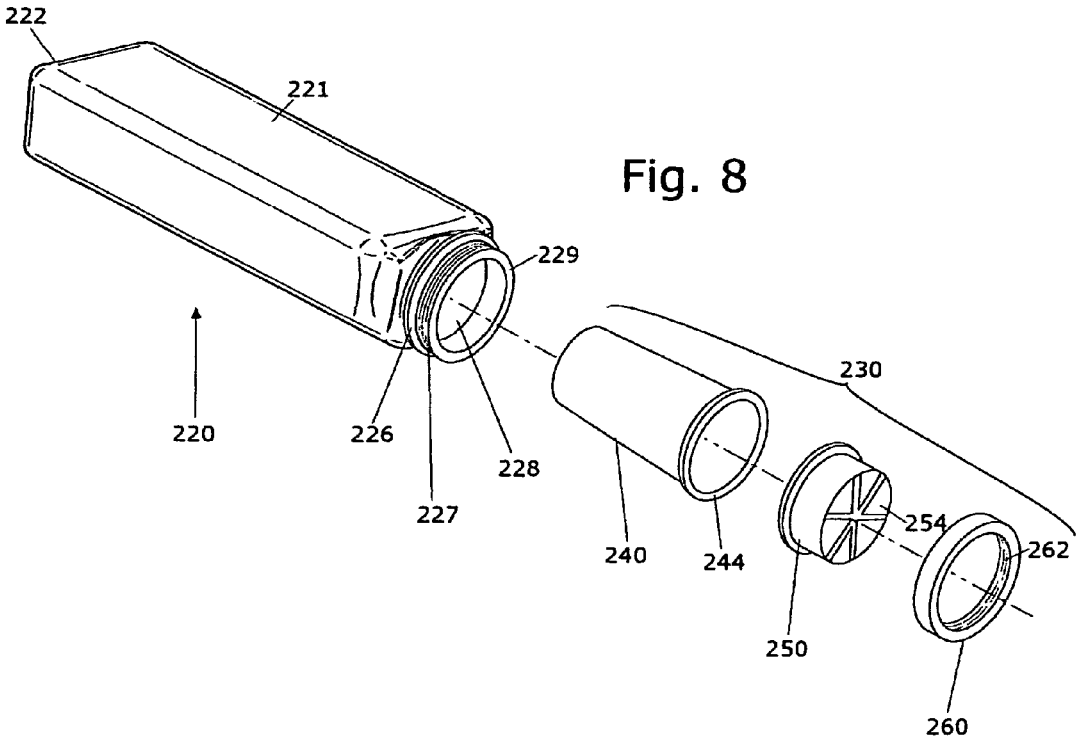
FIG. 8 is an exploded perspective view of another embodiment of the cut flower container.
Figure 9:
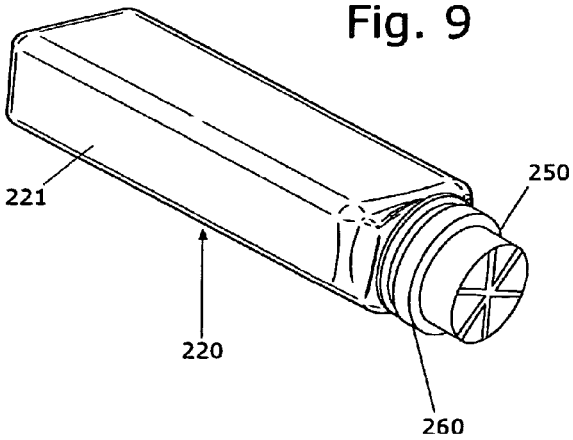
FIG. 9 is a perspective side view of the assembled container shown in FIG. 8.
Figure 10:
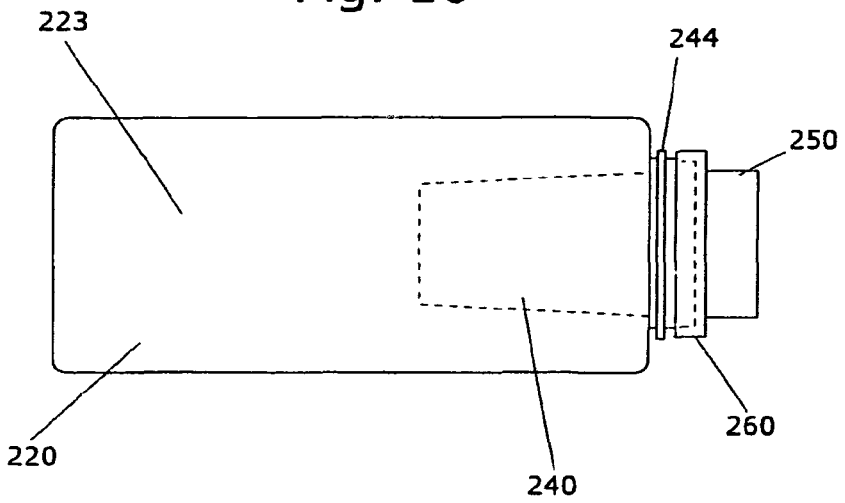
FIG. 10 is an enlarged side elevation of the cut flower container shown in FIG. 8 with a funnel member shown in phantom.
Figure 11:
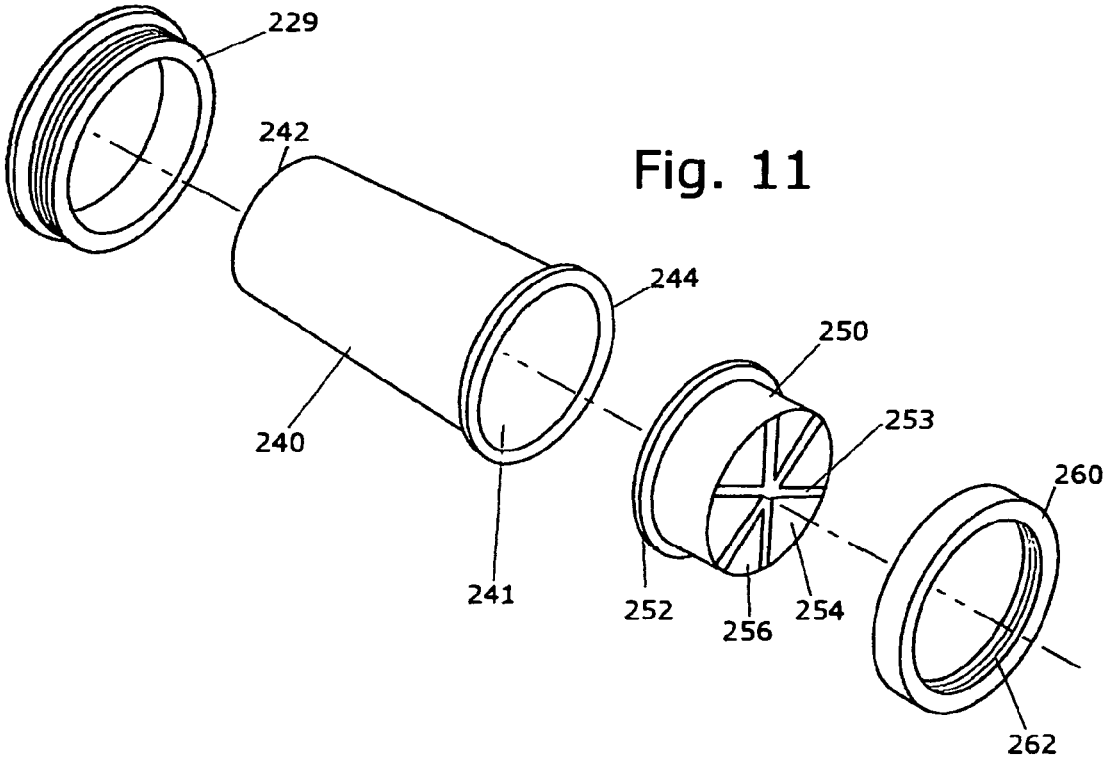
FIG. 11 is an exploded perspective enlarged view of the closure assembly shown in FIG. 8.
Figure 12:
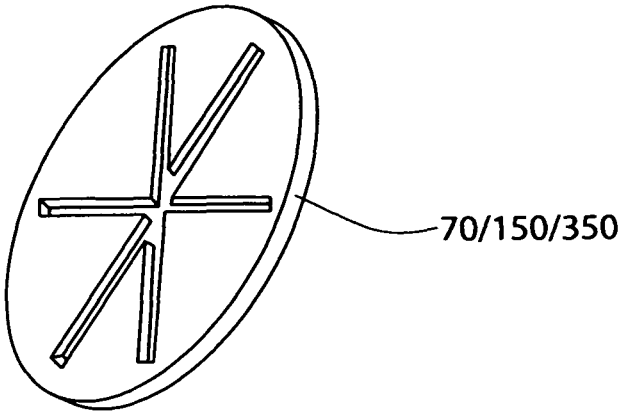
FIG. 12 is an enlarged perspective view of the disc member used in a number of the embodiments.
Figure 13:
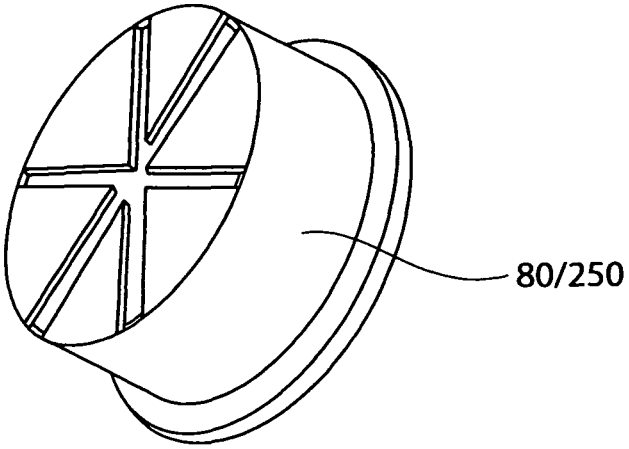
FIG. 13 is an enlarged perspective view of the cylindrical disc member used in a number of the embodiments.

A stem holder and closure member 150 is positioned atop and seated adjacent the lip 144 of the anti-spill funnel insert 140. The closure member 150 is circular disc shaped with flat upper and lower surface and has a diameter approximating that of lip 144. The disc defines a plurality of radial throughgoing slits 156 which run across the substantially diameter of the disc 150 forming flexible wedge shaped sections 158 as seen in FIGS. 6 and 12 to facilitate insertion of cut flower stems into the chamber 123 of the container 120.

A locking ring 160 having internal threads 162 and inwardly projecting flange 164 is mounted over the disc 150 outer circumference and funnel insert lip 144 and neck 126. In use the anti-spill funnel insert 140 is inserted into the chamber 123 of the container 120 through the mouth 128 so that lip 144 is generally adjacent to and flush with the mouth 128 of the receptacle 120. The disc closure member 150 is then positioned atop the anti-spill insert 140 on lip 144 so that it is generally adjacent to and flush with same. In a final assembly step, the locking ring 160 is threaded onto the container neck threads 127 thereby locking and sealing the disc closure member 150 and anti-spill funnel insert 140 onto the mouth 124 of the receptacle 120.

In FIGS. 8 through 11, another embodiment of the container is shown including a container body 220 of generally conventional form and a closure assembly 230 mounted thereto. In this embodiment, the container 220 is also generally formed in the shape of a rectangle or cube. The container 220 has planar sides 221. The container 220 includes a planar bottom 222 facilitating freestanding use of the container and a circular neck 226 which opens into the container chamber 223. The neck 226 interconnects the sides 221 forming a generally circular mouth 228. The neck 226 has external threads 227 that are complimentary to internal threads 262 of the locking ring 260 (discussed in detail below).

The closure assembly 230 is mounted to the neck 226. The closure assembly 230 includes a funnel insert 240 forming a primary closure having an inwardly sloping contiguous sidewall forming a tapered funnel-like, frustum conical structure having openings 241 and 242 at both ends. The opening 241 is defined by lip 244 which is adjacent to and seated flush with the planar end surface 229 of the threaded tubular neck 226. When assembled, the funnel insert 240 projects into the interior chamber 223 of the container 220. It will be understood by one skilled in the art that anti-spill inserts having other shapes may operate in the same or similar manner.

A stem holder and closure member 250 is positioned atop and seated adjacent the lip 244 of the anti-spill insert 240. The closure member 250 is cylindrical and has a diameter approximating that of the first opening 241 with an outwardly extending circumferential lip 252 which is seated on lip 244 of the funnel insert 240 with the opposite end being closed by a thin flexible disc shaped membrane 256. A plurality of slits 258 run across the diameter of the disc shaped membrane 256 to facilitate insertion of cut flower stems into the container 220. In this embodiment, slits 253 are cut in a radiant pattern to form a plurality of flexible wedge shaped sections 254. The distal end of locking ring 260 is flanged inward to provide a stop against circumferential lip 252 of member 250.

Figure 14:
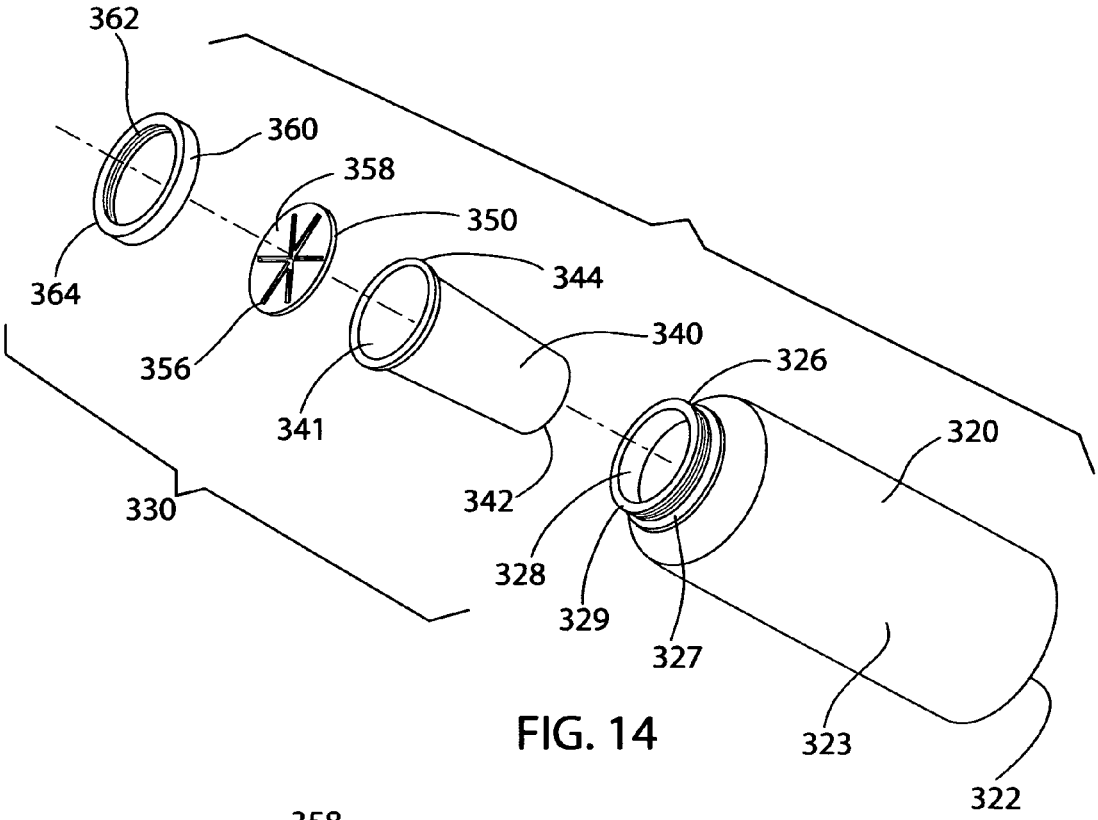
FIG. 14 is an exploded perspective view of a tubular container embodiment of the cut flower container using the flat disc stem holder.
Figure 15:
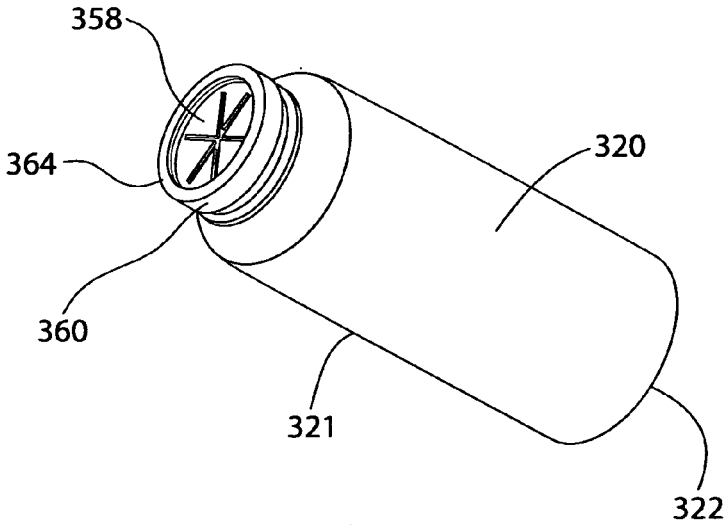
FIG. 15 is an assembled perspective view of the tubular container shown in FIG. 14.
Figure 16:
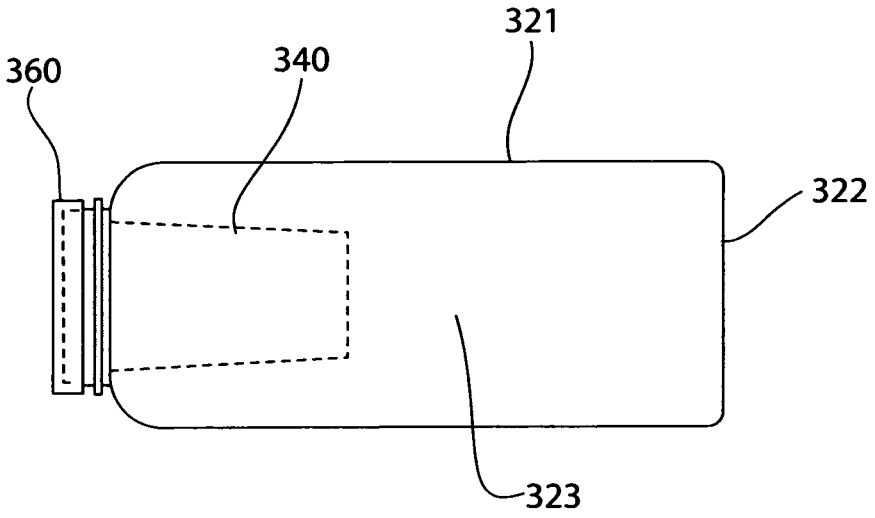
FIG. 16 is a side view partially in phantom of the tubular container shown in FIG. 14.

In FIGS. 14 through 16, a tubular shaped embodiment of the container 320 has closure assembly 330 mounted thereto. The container 320 has a circular sidewall 321 with a planar bottom 322 facilitating freestanding use of the container. A cylindrical neck 326 which is open is interconnected to the sidewall 321 forming a generally circular mouth 328. The neck 326 has external threads 327 that are complimentary to internal threads 362 of the locking ring 360 (discussed in detail below).

The closure assembly 330 is mounted to the cylindrical neck 326. The closure assembly includes a funnel shaped insert 340 having an inwardly sloping contiguous sidewall forming a tapered funnel-like, frustum conical structure having openings 341 and 342 at both ends. The opening 341 is defined by lip 344 which is seated adjacent and flush with the planar end surface 329 of neck 326. When assembled, the funnel insert 340 projects into the interior chamber 323 of the container 320.

A stem holder and closure member 350 is positioned atop and seated adjacent the lip 344 of the funnel 340. The closure member 350 is circular disc shaped with flat upper and lower surface and has a diameter approximating that of lip 344. The disc defines a plurality of radial throughgoing slits 356 which run across the substantially diameter of the disc 350 forming flexible wedge shaped sections 358 to facilitate insertion of cut flower stems into the chamber 323 of the container 320.

A locking ring 360 having internal threads 362 and inwardly projecting flange 364 is mounted over the disc 350 and funnel insert lip 344 and container front end surface 327. In use the anti-spill funnel insert 340 is inserted into the chamber of the receptacle 320 through mouth 328 so that lip 344 is generally adjacent to and flush with the mouth 326 of the receptacle 320. The disc closure member 350 is then positioned atop the anti-spill insert 340 on lip 344 so that it is generally adjacent to and flush with same. In a final assembly step, the locking ring 360 is threaded onto the container neck threads 327 thereby locking and sealing the disc closure member 350 and anti-spill funnel insert 340 onto the mouth 324 of the receptacle 320.

Figure 17:
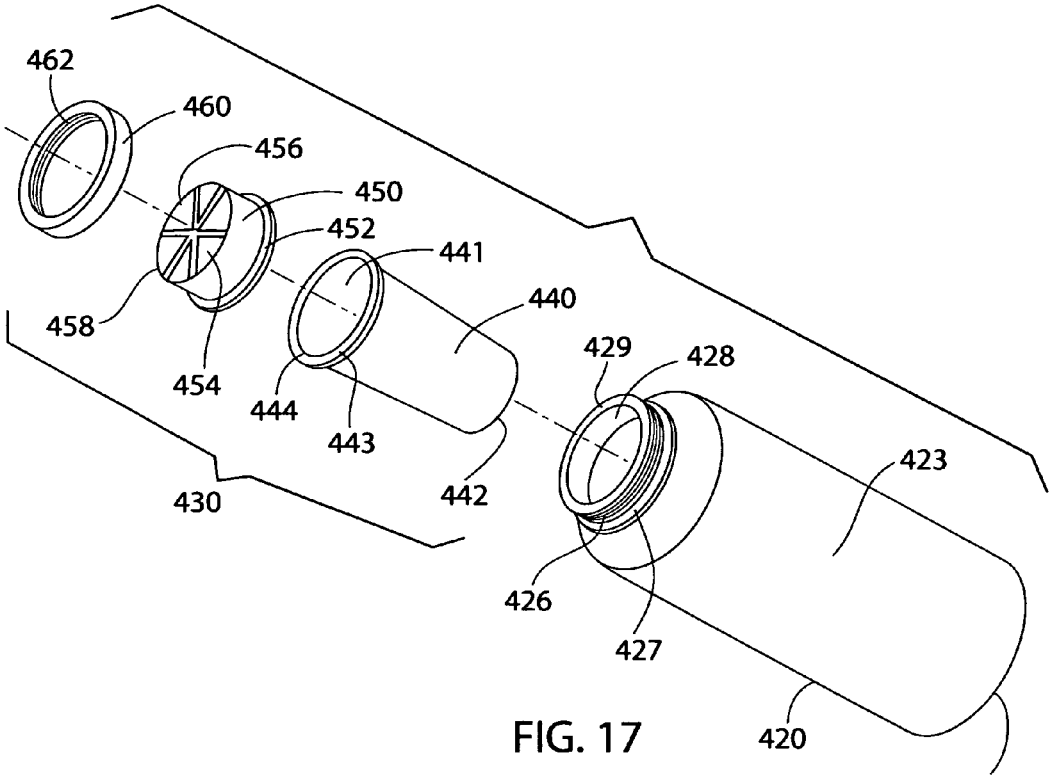
FIG. 17 is an exploded perspective view of another tubular container embodiment of the cut flower container using the cylindrical stem holder with sectional end.
Figure 18:
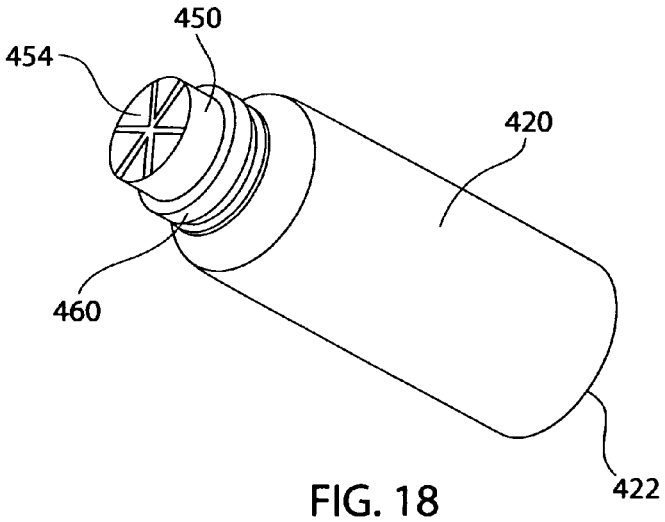
FIG. 18 is an assembled perspective view of the tubular container shown in FIG. 17.
Figure 19:
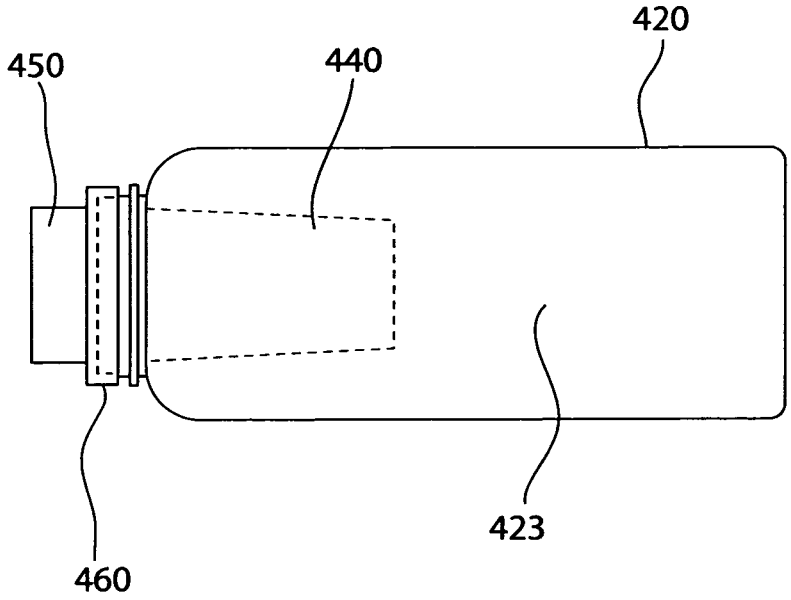
FIG. 19 is a side view with the funnel member shown in phantom of the tubular container shown in FIG. 17.

In FIGS. 17 through 19, another tubular embodiment of the container is shown including a container 420 of generally conventional form and closure assembly 430 mounted thereto. The receptacle 420 has a cylindrical sidewall 421. The receptacle 420 includes a planar bottom 422 facilitating freestanding use of the container and a circular neck 426 which is open. The neck 426 interconnects the sidewall 421 forming a generally circular mouth 428. The neck 426 has external threads 427 that are complimentary to internal threads 462 of the locking ring 460 (discussed in detail below).

The closure assembly 430 is mounted to the neck 426. The closure assembly 430 includes a funnel insert 440 forming a primary closure having an inwardly sloping contiguous sidewall forming a tapered funnel-like, frustum conical structure having openings 441 and 442 at both ends. The opening 441 is defined by lip 444 which is adjacent and flush with the planar end surface 429 of the threaded tubular neck 426. When assembled, the funnel insert 440 projects into the interior chamber 423 of the container 420. It will be understood by one skilled in the art that anti-spill inserts having other shapes may operate in the same or similar manner.

A stem holder and closure member 450 is positioned atop and seated adjacent the lip 444 of the funnel insert 440. The closure member 450 is cylindrical and has a diameter approximating that of the first opening 441 with a circumferential lip 452 which is seated on lip 444 of the funnel insert 440 with the opposite end being closed by a thin flexible disc shaped membrane 456. A plurality of slits 458 run across the diameter of the disc shaped membrane 456 to facilitate insertion of cut flower stems into the container 420. In this embodiment, slits 458 are cut in a radiant pattern to form a plurality of flexible wedge shaped sections 454. The distal end of closure member 450 is flanged inward to provide a stop against circumferential lip 452.

A locking ring 460 having internal threads 462 and inwardly projecting flange 464 is mounted over the disc 450 and funnel insert lip 444 and container front end surface 427. In use the anti-spill funnel insert 440 is inserted into the chamber of the receptacle 420 through mouth 428 so that lip 444 is generally adjacent to and flush with the mouth 426 of the receptacle 420. The disc closure member 450 is then positioned atop the anti-spill insert 440 on lip 444 so that it is generally adjacent to and flush with same. In a final assembly step, the locking ring 460 is threaded onto the container neck threads 427 thereby locking and sealing the disc closure member 450 and anti-spill funnel insert 440 onto the mouth 424 of the receptacle 420.

The hydrating solution used in the container may include but is not limited to anti-microbial additives, bactericidal additives, bacteriostatic additives, germicidal additives, biocidal additives, fungicidal additives, growth adjuvants, viability adjuvants, fertilizers, and the like.

As noted supra, it is contemplated that the containers can be large holding 14 oz. of hydrating fluid, medium 9.5 oz. of hydrating fluid and small 4.6 oz. of hydrating fluid. Alternatively, it is further contemplated that the closure assembly of the present invention may be manufactured to be retro-fitted onto existing containers.

It should also be noted that all of the containers can have particles ranging in size from about 1000 to about 4000 microns of cross-linked potassium polyacrylate placed filled in the container chamber. This will yield a gel-like material with the addition of water. Such material can be commercially obtained from Evonik Stockhausen GmbH under the product name STOCKOSORB® 660XL.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What is claimed is:

1. An anti-spill cut flower container comprising:

a container body comprising a plurality of sidewalls including a proximal portion and a distal portion, a planar bottom adjacent to and contiguous with the distal portion of said sidewalls, the sidewalls and the bottom defining a chamber, a neck section secured to the proximal portion of said sidewalls, said neck section defining a planar end surface and circular opening leading to said chamber, the neck section being threaded on an external surface;

a first a funnel member defining an extending lip portion extending from funnel member body seated on said neck adjacent said circular opening and extending down into said container chamber, said funnel member lip portion defining a planar end surface, said first funnel member being provided a closed end with through going apertures formed therein allowing passage of fluids there through, a second funnel member of lesser length than the first funnel member, said second funnel member defining an extending lip portion with a planar end surface which is adapted to be seated on said first funnel member planar end surface, said second funnel member having a higher angle of tapering than said first funnel member and being sized to fit within said first funnel member, a first closure member mounted adjacent said second funnel member lip portion comprising a radially slotted disc member defining a plurality of flexible sections seated on said second funnel member lip portion; a second closure member mounted on said first closure member, said second closure member comprising a cylindrical body defining a lip extending outward from said second closure member cylindrical body at a proximal end of said second closure member cylindrical body and a planar fluid restriction member formed at a distal end of said second closure member cylindrical body defining a plurality of separated flexible sections, and an internally threaded locking ring defining a centrally positioned through going aperture, said locking ring securing said first and second closure members, said first and second funnel members and said container body together.

2. An anti-spill cut flower container as claimed in claim 1 wherein said container body is rectangular.

3. An anti-spill cut flower container as claimed in claim 1 wherein said container body is cylindrical.

4. An anti-spill cut flower container as claimed in claim 1 wherein said first closure member is a flat surfaced disc.

5. An anti-spill cut flower container as claimed in claim 1 wherein said first funnel member is frustum-conical.

6. An anti-spill cut flower container as claimed in claim 1 wherein said internally threaded locking ring has a flange section extending into said centrally positioned through going aperture which acts as a stop against said second closure member.

7. An anti-spill cut flower container as claimed in claim 1 wherein said separated flexible sections are defined by a plurality of through going slits incised in a radiant pattern.

8. An anti-spill cut flower container as claimed in claim 1 further including a foam member sized to be seated in a bottom portion of said first funnel member adjacent said closed end.

* * * * *